US005325537A

United States Patent [19]

Marion

[11] Patent Number: 5,325,537

[45] Date of Patent: Jul. 5, 1994

[54] ATHLETIC SAFETY JACKET

[76] Inventor: Sebastino T. Marion, 21821 Lakeview, St. Clair Shores, Mich. 48080

[21] Appl. No.: 736,548

[22] Filed: Jul. 26, 1991

[51] Int. Cl.[5] ..... A41D 13/00

[52] U.S. Cl. ..... 2/2; 2/108; 2/102; 2/25; 2/243.1

[58] Field of Search ..... 2/108, 102, 2, 2.5, 2/243 R, 243 A, 243.1

[56] References Cited

U.S. PATENT DOCUMENTS

| | | | |
|---|---|---|---|
| 1,468,505 | 9/1923 | La Rizza | 2/108 |
| 3,125,762 | 3/1964 | Glahe | 2/2 |
| 3,550,159 | 12/1970 | Alarco | 2/2 |
| 3,991,420 | 11/1976 | Savarino | 2/2 |
| 4,261,059 | 4/1981 | Spitz | 2/108 |
| 4,422,183 | 12/1983 | Landi et al. | 2/2 |
| 4,441,211 | 4/1984 | Donzis | 2/2.5 |
| 4,525,875 | 7/1985 | Tomczak | 2/2 |
| 4,602,385 | 7/1986 | Warren | 2/2 |
| 4,648,136 | 3/1987 | Higuchi | 2/2.5 |
| 4,847,913 | 7/1989 | Chen | 2/2 |
| 4,923,728 | 5/1990 | Snedeker | 2/2.5 |
| 4,993,076 | 2/1991 | Diericky | 2/2.5 |
| 5,020,156 | 6/1991 | Neuhalfen | 2/2.5 |

*Primary Examiner*—Clifford D. Crowder
*Assistant Examiner*—Gloria Hale

[57] ABSTRACT

An athletic safety jacket operable to reduce the shock to the body resulting from impact of a fast moving game projectile such as a hockey puck or baseball.

7 Claims, 2 Drawing Sheets

ATHLETIC SAFETY JACKET

This invention relates generally to athletic safety devices. More particularly, this invention relates to an athletic safety jacket operable to reduce the shock to the body resulting from impact of a fast moving game projectile such as a hockey puck or baseball.

Protective garments for specific use in athletic enterprise have been devised in a long history of a variety of designs. For example, U.S. Pat. No. 2,589,636 issued in 1952 to Smith discloses a shooting garment. This garment is a shooting jacket that has padding at the elbows. The elbow padding reduces chafing and fatigue. The garment is heavy, enclosed, hot, and has permanently fixed sleeves.

In sharp contrast to the Smith disclosure, it is an object of the subject invention to provide an athletic safety jacket that is light, has a plurality of open apertures, cool to the wearer, and has detachable sleeves.

U.S. Pat. No. 1,796,782 issued in 1931 to Gasperini discloses a signal device and garment protector for automobile drivers. This device is a combination integral body side cover and single sleeve. It is designed for use in thrusting the arm and hand through an open side curtain in making turn signals. The sleeve and side cover are not designed to attach to other clothing. Turn signaling is hardly an athletic enterprise, and there is no design to protect from fast moving projectiles of any kind.

In contrast to the Gasperini disclosure, it is an object of the subject invention to provide an athletic protective garment that covers the chest and has a selectively attachable and detachable sleeve.

U.S. Pat. No. 2,468,841 issued in 1949 to Seigel discloses a chest protector. This device covers part of the upper chest with soft wool or cotton stuffed between two layers of fabric.

In contrast to Seigel, it is an object of the subject invention to cover the upper chest and other parts of the body with fabric covered rigid members capable of increasing the area of protection from sharp impact and thus reducing stress concentrations.

U.S. Pat. No. 2,516,598 issued in 1950 to Selkirk discloses a protecting garment. Separate pants and partial upper vest are provided with a quilted padding. No protection for the back is provided.

In contrast to Selkirk, it is an object of the subject invention to protect the back and sides of a player with a quilted garment of fabric covered rigid members, unlike soft padding, where the garment integrally protects the chest and selectively protects the arms with detachable sleeves as well.

U.S. Pat. No. 2,320,705 issued in 1943 to Reynolds discloses a kidney guard. The guard is formed of fiber to withstand impact with the ground or collision from body contact. The guard is not integral with any clothing.

In contrast to Reynolds, it is an object of the subject invention to use structure representing a waffle with a plurality of fabric covered rigid members made of compressed dense plastic foam that are integral to an athletic jacket that are resistant, and capable of spreading the impact of an athletic projectile moving at high speed to effectively reduce the stress of impact on the wearer.

U.S. Pat. No. 1,516,644 issued in 1924 to Pierce discloses a shoulder guard. The guard is used as armor in protecting a football player from rough and hard body contact with other football players. The armor is made from rigid tubes of fiber held by leather strips to fabric. No attachment to other garments is disclosed.

In contrast to Pierce, it is an object of the subject invention to provide protective armor comprised of a plurality of rigid plastic members integrally attached to fabric of a jacket that protects the chest, sides, back and selectively the arms of an athletic participant from injury due to impact with a fast moving game projectile.

U.S. Pat. No. 3,500,472 issued in 1970 to Castellani discloses football and baseball equipment. A sleeveless chest protector with straps for holding around the back of a player is disclosed. The armor in the protector comprises flexible pocket means, which by means of stitching or gluing form a plurality of pockets. In each pocket is an inflatable cushion.

In sharp contrast, it is an object of the subject invention to provide pockets of rigid plastic, unlike soft air cushions, capable of spreading the area of protection from sharp hard impact to reduce concentrated shock.

U.S. Pat. No. 3,076,197 issued in 1963 to Glahe discloses a chest protector. No back, sides, or sleeves are disclosed. Parallel bands of padding with vertical separations to facilitate movement of the catcher is disclosed.

In contrast, it is an object of the subject invention to provide vertical and horizontal further compressed foam-fabric sandwich to facilitate movement of a player where the further compressed foam-fabric sandwich separates rigid members, unlike soft padding and a quilt effect of a plurality of rigid members to cover a significant part of the body in an integral garment far more than just the chest.

U.S. Pat. No. 2,990,549 issued in 1961 to Doughty discloses a Batter's protector. A quilted half vest is provided which is left handed and right reversible. A diamond shaped plurality of quilts enclose with fabric a flexible panel of resilient and flexible pad of sponge rubber. U.S. Pat. No. 3,574,861 issued in 1971 to Hale discloses a chest and throat protector. The garment comprises horizontally arrayed padded segments that are also segmented vertically. U.S. Pat. No. 4,847,913 issued in 1989 to Chen discloses baseball chest protector. A chest protector of a quilt of substantially square and rectangular segmented flexible soft foam is provided. U.S. Pat. No. 4,100,620 issued in 1978 to Pecoraro discloses a body protector. A sleeveless vest of interiorly diamond shaped quilts of foamed soft polyethylene of a padding of soft acrylic fibers are enclosed front and back by fabric. In sharp contrast, it is an object of the subject invention to provide a diamond waffle of fabric covered pads of rigid plastic in more than a half vest, but a full vest covering the back, front and both sides of a batter, and having selectively detachable sleeves. U.S. Pat. No. 4,441,211 issued in 1984 to Doaxis discloses a protective batting jacket. Enclosed pockets of fluid are provided in the jacket to absorb shock.

In sharp contrast, it is an object of this invention to provide solid rigid shields in a continuous manner to effectively spread the area of protection from impact in order to reduce the stress by spreading the force over a larger area.

U.S. Pat. No. 3,991,420 issued in 1976 to Savarino discloses a protective baseball batting garment. Hard pads are provided at the elbow, forearm and biceps. The hard pads are made of plastic. U.S. Pat. No. 3,162,861 issued in 1964 to Gustafson discloses a batter's chest protector. A rigid piece of plastic covering the entire chest has an inner resilient linear of flexible resilient material like foam rubber. U.S. Pat. No. 4,373,211 issued to Goudreau et al discloses a protective chest shield. A shield covering the side of a batter is disclosed. The shield is made of a sheet of polyvinyl chloride closed cell foam that is relatively thick covered with a relatively thin sheet of polypropylene.

In contrast, it is an object of the present invention to provide compressed dense plastic foam surfaces embedded continuously in a structure representing a waffle all over the upper torso of a player, and similarly dispersed armor all over the arm of the batter facing the pitcher.

U.S. Pat. No. 4,084,264 issued in 1978 to Marion discloses a batter training safety jacket. A jacket with detachable sleeves and thick padding is disclosed.

The present invention is an improvement in that it has an object of providing rigid compressed dense plastic foam pieces unlike thick padding embedded continuously in a waffle pattern to facilitate flexibility and resistant to reduce sharp stresses.

In recent years, several deaths have been experienced by young children playing baseball, where the deaths were caused by defibrillation of the heart induced by the shock of sharp high intensity stress from impact of a fast moving baseball. Hundreds of thousands, if not millions of young children play less aggressive baseball from fear of painful or serious injury from impact with a baseball projectile. Similar fears diminish performance of young athletes in other sports engrossed in fast moving projectiles such as ice hockey.

Accordingly, it is an object of the present invention to provide the means to reduce impact stress from collision with a fast moving projectile by providing a continous armor where the compression border linked raised squares comprise a dense plastic foam rigid energy absorber operable to spread over a larger area protection from the impact of collision.

It is a further object of this invention to provide a hard rigid shield over the heart, with a surface area of the same order of magnitude as the largest side of the heart, and fixed to a flexible armored jacket.

It is a still further object of this invention to provide an athletic safety jacket securable by VELCRO hook and loop fasteners, having a flexible waffle of rigid shields, that has a plurality of apertures to provide breathing and to facilitate evaporation, that is light in weight, relatively cool to wear, and that is inexpensive and uncomplicated to make, use, and maintain.

These and other objects of this invention are achieved by the provision of an athletic safety jacket that is light, has a plurality of open apertures, cool to the wearer, and has detechable sleeves; an athletic protective garment that covers the chest and has a selectively attachable and detachable sleeve; to cover the upper chest and other parts of the body with fabric covered rigid members capable of increasing the area of protection from sharp impact and thus reducing stress concentrations; to protect the back and sides of a player with a quilted garment covered by rigid members, unlike soft padding where the garment's composition and construction work together to protect the entire the chest and selectively protects the arms with detachable sleeves as well; to use a formation representing a waffle of a plurality of fabric covered rigid members made of compressed dense plastic foam that are resistant and integral to an athletic jacket capable of spreading the impact of an athletic projectile moving at high speed to effectively reduce the stress of impact on the wearer; to provide protective armor comprised of a plurality of rigid plastic members integrally attached to fabric of a jacket that protects the chest, sides, back and selectively the arms of an athletic participant from injury due to impact with a fast moving game projectile; to provide pockets of rigid plastic, unlike soft cushions, capable of spreading the area of protection from sharp hard impact to reduce concentrated shock; to provide vertical and horizontal compression borders to facilitate movement of a player where the further compressed foam-fabric sandwich separates rigid members, and a waffle effect of a plurality of rigid members cover a significant part of the body in an integral garment far more than just the chest; to provide a diamond waffle of fabric covered pads of rigid plastic in more than just a half vest, but a full vest covering the back, front and both sides of a batter, and having a selectively detachable sleeves to provide solid rigid shields to effectively increase the area of protection from impact in order to reduce the stress by spreading the force over a larger area; to provide compressed dense plastic foam surfaces embedded in a fabric waffle all over the upper torso of a player, and similarly dispersed armor all over the arm of the batter facing the pitcher; providing rigid compressed dense plastic foam pieces embedded in a waffle pattern to reduce sharp stresses; to provide the means to reduce impact stress from collision with a fast moving projectile by providing a continuous armor where the rigid squares comprise a compressed dense plastic foam rigid energy absorber operable to spread over a larger area protection from the impact of collision; to provide a hard rigid shield over the heart, with a surface area of the same order of magnitude as the largest side of the heart, and fixed to a flexible armored jacket; to provide an athletic safety jacket securable by VELCRO hook and loop fasteners, having a flexible waffle of rigid shields, that has a plurality of apertures to provide breathing and to facilitate evaporation, that is light in weight, relatively cool to wear, and that is inexpensive and uncomplicated to make, use, and maintain.

These and other objects of this invention can be understood from the following specifications and claims.

ON THE DRAWINGS

Before explaining the present invention in detail, it is to be understood that the invention is not limited in its application to the details in construction and arrangement of parts illustrated in the accompanying drawings since the invention is capable of other embodiments and of being practiced or carried out in various ways.

Also it is to be understood that the phraseology and terminology employed herein are for the purpose of description and not of limitation.

AS SHOWN ON THE DRAWINGS

Figure 1:
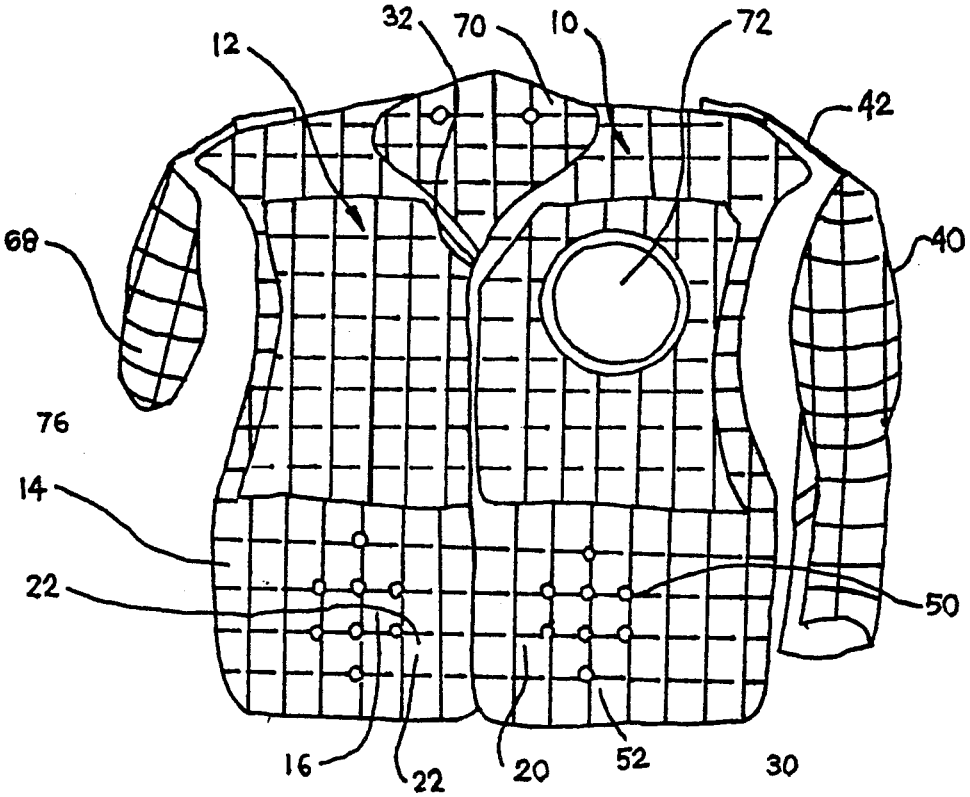
FIG. 1 is a front view of an alternative embodiment of this invention.
Figure 5:
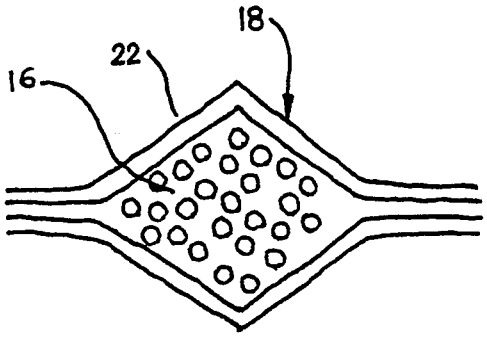
FIG. 5 is a transverse sectional view of the article shown in FIG. 4 taken by the section lines 5—5 thereof.
Figure 6:
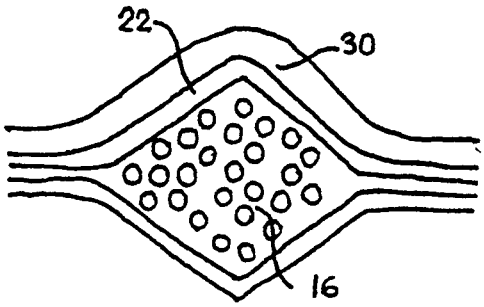
FIG. 6 is an enlarged transverse sectional view of the article shown in FIG. 2.
Figure 4:
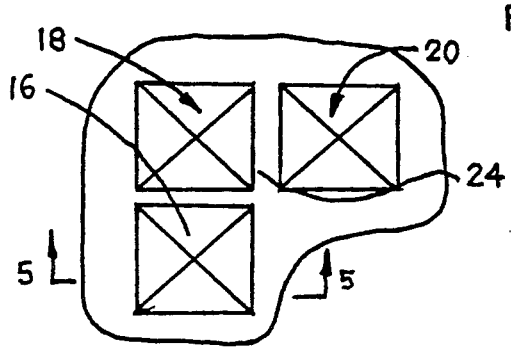
FIG. 4 is an enlarged front view of a portion of the article shown in FIG. 2.

A catcher's safety jacket 10 is an alternative embodiment of this invention illustrated in FIG. 1. The preferred manufacture of this invention is a fabrication process that utilizes fabric, dense plastic foam, aluminum compression dies, aluminum cutting dies, heat and a lamination process such as that done by JANCO of Dover. The upper torso portion 12 of the vest 14 that is comprised of two layers of fabric cover 18 and one layer of dense plastic foam 16 that is compressed during a heat stage of the process and converted into rigid members 16 linked together by compression borders 24 to form an armored shield 20. The compression borders 24 are formed by the compression dies during the heat stage of a lamination process. The final stage of the fabrication process utilizes the cutting die to create open apertures 50 and correct sizing. The last stage of the preferred manufacture is a finishing process which attaches the binding, VELCRO hook and loop fasteners, shoulder clips or other previously mentioned attachment to the embodiment. A preferred composition of the rigid members 16 is compressed dense plastic foam of closed cell polyethylene such as that made by JANCO of Dover, N.H.

The rigid members are square shaped in plan view and diamond shaped in cross-section forming a pyramidal shaped projection toward both the inside and outside of the garment. The preferred fabric cover of the compressed dense foam is LYCRA spandex in order to provide adequate strength and light weight.

The vest 14 is preferably selectively closed and opened with VELCRO hook and loop fasteners 32 in a manner well understood in the fastener art.

A hard plastic shield 30 is fixed to the vest proximate the heart of the wearer and has a surface area of the same order of magnitude as the largest side of the heart. The shield is preferably 0.060 inch thick panel of polypropylene hard plastic shell. This shell is molded to mate with the compressed borders of the raised squares 16 to provides flexibility of movement and close fit therewith. Note that in this catcher alternative embodiment the throwing arm of the catcher has a shortened sleeve 68. A neck protective portion 82 comprises armor 20.

The sleeves 40 are selectively detachable from the vest 14 by means of VELCRO hook and loop fasteners 42. A decorative insignia 72 can be provided. Additional fastening means 76, such as a belt and corresponding buckle can be provided.

Substantially circular peripheral apertures 50 form open apertures and are disbursed throughout the armor 52 to lessen the weight of the jacket and to promote evaporation of sweat and air conduction to cool the wearer.

Figure 2:
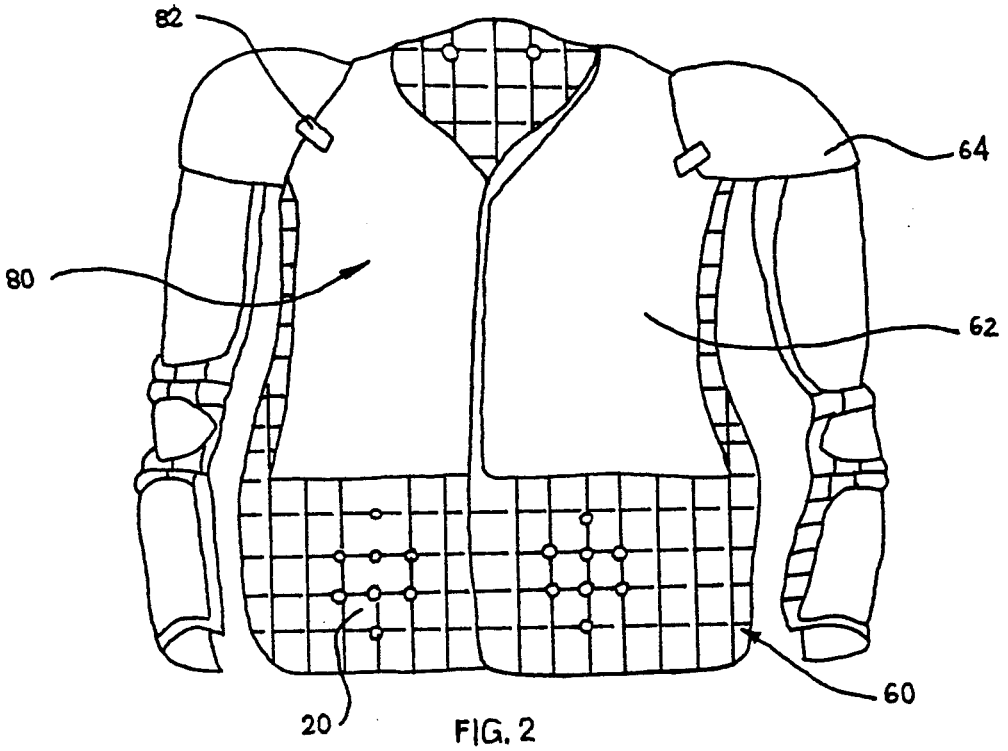
FIG. 2 is a front view of the preferred embodiment of this invention.
Figure 3:
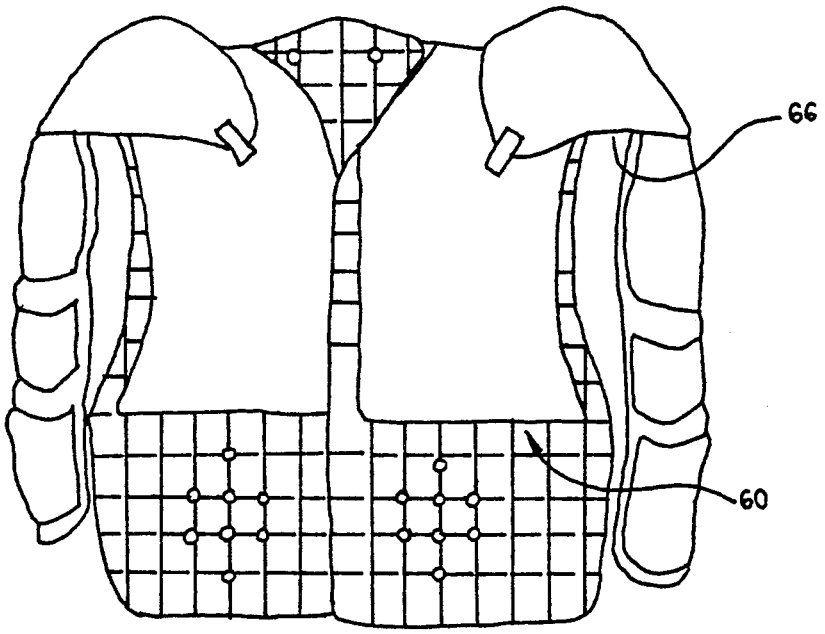
FIG. 3 is a back view of the article shown in FIG. 2.

The preferred embodiment of this invention is illustrated in FIGS. 2 and 3 illustrating the front and back, of a hockey safety jacket 60. The hard plastic shields 62 and shoulder pads 64 are preferably made of 0.080 inch thick panels of polypropylene hard plastic and preferably secured by fabric and rivets (not shown) to the vest of mail 20. The shoulder pads once secured by fabric and rivets are hung to the chest panels in such a manner as well known in the art so as to provide a significant air cushion 66, created by the distance between the placement of the shoulder pad to the chest panel, when hit with a fast moving impact.

In the preferred embodiment of this invention, the mail 16 is made by compressing polyethylene foam in dies, applying heat in the range of 200 to 900 degrees Fahrenheit, holding under compression in a range of 5 to 17,000 psi and simultaneous heat at the upper range for a period of 30 seconds to 5000 seconds, and cooling to a lower range of 50 to 150 degrees Fahrenheit for a period of 50 to 2400 seconds.

I claim:

1. An athletic safety protector for protecting a wearer from projectiles in sports activities comprising in combination a jacket having an upper torso covering portion forming a shield and removably attached sleeves attached to the upper torso covering portion at the shoulders with hook and loop features wherein each sleeve forms arm shields; said shields are constructed of a plurality of rigid members over their entirety comprised of compressed dense plastic closed cell polyethylene foam;

said rigid members being enclosed between two fabric layers;

said fabric layers being quilted together between said rigid members forming flattened compression borders therebetween to allow the bending of the shields and freedom of movement to the wearer; some of said flattened compressed borders between said rigid members having apertures therein to allow air flow between the wearer and the environment to cool the wearer and to lessen perspiring of the wearer while said jacket is worn; wherein said rigid members are square shaped in plan view and diamond shaped in cross-section forming a pyramidal shaped projection toward both the inside and outside of the garment.

2. An athletic safety protector as claimed in claim 1 including a hard plastic heart shield affixed to the upper torso covering portion in the area of the heart of the wearer.

3. An athletic safety protector as claimed in claim 2 wherein said plastic heart shield is comprised of polypropylene.

4. An athletic safety protector as claimed in claim 1, wherein said torso covering portion has at least one rigid plastic shield attached to and covering said fabric and said enclosed rigid members forming an armor.

5. An athletic safety protector as claimed in claim 4, wherein said plastic shields are comprised of polypropylene.

6. An athletic safety protector as claimed in claim 1, wherein said torso covering portion and each sleeve attached is further covered by at least one rigid plastic shield forming an armor.

7. An athletic safety protector as claimed in claim 6, wherein said rigid plastic shields are comprised of polypropylene.

* * * * *